US009812089B2

(12) United States Patent
Wen et al.

(10) Patent No.: US 9,812,089 B2
(45) Date of Patent: Nov. 7, 2017

(54) METHOD OF RAISING CONTRAST OF OLED DISPLAY PANEL AND SYSTEM

(71) Applicant: Shenzhen China Star Optoelectronics Technology Co., Ltd., Shenzhen (CN)

(72) Inventors: Yichien Wen, Shenzhen (CN); Shensian Syu, Shenzhen (CN); Mingjong Jou, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 82 days.

(21) Appl. No.: 14/892,203

(22) PCT Filed: Oct. 26, 2015

(86) PCT No.: PCT/CN2015/092793
§ 371 (c)(1),
(2) Date: Nov. 19, 2015

(87) PCT Pub. No.: WO2017/063223
PCT Pub. Date: Apr. 20, 2017

(65) Prior Publication Data
US 2017/0193964 A1 Jul. 6, 2017

(51) Int. Cl.
*G09G 5/10* (2006.01)
*G09G 3/20* (2006.01)

(52) U.S. Cl.
CPC ..... *G09G 5/10* (2013.01); *G09G 3/2003* (2013.01); *G09G 2320/066* (2013.01); *G09G 2380/02* (2013.01)

(58) Field of Classification Search
None
See application file for complete search history.

(56) References Cited

U.S. PATENT DOCUMENTS 5,063,448 A * 11/1991 Jaffray ..... H04N 1/40093 348/578
8,962,382 B2 * 2/2015 Lee ..... H01L 51/5088 438/22

(Continued)

FOREIGN PATENT DOCUMENTS

CN 101127198 A 2/2008
CN 101650921 A 2/2010

(Continued)

*Primary Examiner* — Barry Drennan
*Assistant Examiner* — Jason Pringle-Parker
(74) *Attorney, Agent, or Firm* — Leong C. Lei

(57) ABSTRACT

A method of raising contrast of an OLED display panel converts an original RGB signal into a HSI color space constructed by a hue component, a saturation component and an intensity component, and implements histogram statistics to the intensity component to obtain a histogram of the intensity component, and obtains a conversion parameter according to the histogram of the intensity component, and obtains the new low driving voltage with calculation of the conversion parameter in combination with the original low driving voltage, and meanwhile, keeps the hue component and the saturation component unchanged, and implements enhancement treatment to the intensity component to obtain a new intensity component, and then, converts the hue component, the saturation component and the new intensity component into a RGB color space to obtain a new R'G'B' signal supplied to a pixel driving circuit.

10 Claims, 7 Drawing Sheets

(56) References Cited

U.S. PATENT DOCUMENTS

| | | | | |
|---|---|---|---|---|
| 9,007,353 | B2 * | 4/2015 | Kuo | H01L 27/3269 345/207 |
| 2006/0250385 | A1 * | 11/2006 | Plut | G09G 5/00 345/211 |
| 2011/0254883 | A1 * | 10/2011 | Tsai | G09G 3/3233 345/691 |
| 2013/0335439 | A1 * | 12/2013 | Jeong | G09G 5/02 345/590 |

FOREIGN PATENT DOCUMENTS

| | | | |
|---|---|---|---|
| CN | 103400566 | A | 11/2013 |
| CN | 104505035 | A | 4/2015 |

* cited by examiner

METHOD OF RAISING CONTRAST OF OLED DISPLAY PANEL AND SYSTEM

FIELD OF THE INVENTION

The present invention relates to a display technology field, and more particularly to a method of raising contrast of an OLED display panel and a system.

BACKGROUND OF THE INVENTION

The Organic Light Emitting Display (OLED) possesses many outstanding properties of self-illumination, low driving voltage, high luminescence efficiency, short response time, high clarity and contrast, near 180° view angle, wide range of working temperature, applicability of flexible display and large scale full color display. The OLED is considered as the most potential display device.

The OLED can be categorized into two major types according to the driving ways, which are the Passive Matrix OLED (PMOLED) and the Active Matrix OLED (AMOLED), i.e. two types of the direct addressing and the Thin Film Transistor matrix addressing. The AMOLED comprises pixels arranged in array and belongs to active display type, which has high lighting efficiency and is generally utilized for the large scale display devices of high resolution.

The AMOLED is a current driving element. When the electrical current flows through the organic light emitting diode, the organic light emitting diode emits light, and the brightness is determined according to the current flowing through the organic light emitting diode itself. As shown in FIG. 1, the most commonly used AMOLED pixel driving circuit comprises two thin film transistors (TFT) and one capacitor, i.e. a 2T1C pixel driving circuit. Specifically, the 2T1C AMOLED pixel driving circuit comprises a first thin film transistor T1, a second thin film transistor T2 and a capacitor C. The first thin film transistor T1 is a switching thin film transistor, and the second thin film transistor T2 is a driving thin film transistor, and the capacitor C is a storage capacitor. A gate of the first thin film transistor T1 is electrically coupled to a scan signal GN, and a source is electrically coupled to a data signal SN, and a drain is electrically coupled to a gate of the second thin film transistor T2 and one end of the capacitor C; a drain of the second thin film transistor T2 is electrically coupled to a high driving voltage OVDD, and a source is electrically coupled to an anode of an organic light emitting diode D; a cathode of the organic light emitting diode D is electrically coupled to a low driving voltage OVSS'; the one end of the capacitor C is electrically coupled to the drain of the first thin film transistor T1, and the other end is electrically coupled to the drain of the second thin film transistor T2. When the AMOLED displays, the scan signal GN controls the first thin film transistor T1 to be on, and the data signal SN enters the gate of the second thin film transistor T2 and the capacitor C through the first thin film transistor T1, and then the first thin film transistor T1 is off. With the storage function of the capacitor C, the voltage of the gate of the second thin film transistor T2 still can keep the voltage of the data signal to make the second thin film transistor T2 in an on state. The driving current Ioled enters the organic light emitting diode D through the second thin film transistor T2 to drive the organic light emitting diode D to emit light. The illumination intensity of the organic light emitting diode D is related with the driving current Ioled passing through the organic light emitting diode D. The driving current Ioled is influenced by the voltage difference ΔVoled between the anode and the cathode of the organic light emitting diode D. As shown in FIG. 2, with the increase of the ΔVoled, the Ioled also constantly increases, and ΔVoled=Vs−OVSS, wherein Vs is the voltage of the source of the second thin film transistor T2, and the OVSS is the low driving voltage, and the power consumption of the organic light emitting diode D is that P=Ioled×ΔVoled. Therefore, as shown in FIG. 3, with the increase of the Ioled, the intensity Lum of the organic light emitting diode D also gradually increases.

With the constant development of the OLED display technology, the consumers have higher and higher demands to the display quality of the OLED display panel. The contrast of the OLED display panel required to be promoted in advance to raise the display quality of the OLED display panel. Generally, the prior art is to directly implement contrast enhancement treatment to the image in the RGB space model. Such treatment can easily generate the defect of losing colors and HSI is a color space model established according to the intuitive features of the colors. The HSI color space is developed from based on the visual system of the human. The hue H, the saturation S and the intensity I are employed to describe the color, and can clearly express the variations of the hue H, the saturation S and the intensity I.

SUMMARY OF THE INVENTION

An objective of the present invention is to provide a method of raising contrast of OLED display panel. The contrast of the OLED display panel can be raised with the method to promote the display quality of the OLED display panel and meanwhile, to reduce the power consumption of the OLED display panel.

Another objective of the present invention is to provide a system of raising contrast of OLED display panel. The system can raise the contrast of the OLED display panel to promote the display quality of the OLED display panel and meanwhile, to reduce the power consumption of the OLED display panel.

For realizing the aforesaid objectives, the present invention provides a method of raising contrast of an OLED display panel, comprising steps of:

step 1, providing an original RGB signal and an original low driving voltage of an image to be inputted to the OLED display panel;

step 2, converting the original RGB signal into a HSI color space constructed by a hue component, a saturation component and an intensity component;

step 3, implementing histogram statistics to the intensity component to obtain a histogram of the intensity component;

step 4, calculating according to the histogram of the intensity component to obtain a conversion parameter;

step 5, keeping the hue component and the saturation component unchanged, and implementing enhancement treatment to the intensity component with a contrast enhancing method to obtain a new intensity component;

step 6, calculating the conversion parameter and the original low driving voltage to obtain a new low driving voltage, and a formula is: OVSS'=K×X×OVSS, wherein OVSS' is the new low driving voltage, K is a constant coefficient, and X is the conversion parameter, and OVSS is the original low driving voltage;

step 7, converting the hue component, the saturation component and the new intensity component into a RGB color space to obtain a new R' G' B' signal, and inputting the new R' G' B' signal and the new low driving voltage to a pixel driving circuit in the OLED display panel, and the OLED display panel shows a new image with an enhanced contrast.

A specific procedure of the step 5 of implementing enhancement treatment to the intensity component with the contrast enhancing method to obtain the new intensity component is:

step 51, calculating an absolute value Q1 of a difference of intensity values of pixels of two adjacent rows in each same column and a first intensity value weight k1;

a formula of the absolute value Q1 of the difference of intensity values of pixels of two adjacent rows in each same column is:

$$Q1=\mathrm{abs}(I(i,j)-I(i+1,j))$$

a formula of the first intensity value weight k1 is:

$$k1=\frac{\sqrt[n]{256}}{\sqrt[n]{Q1}}$$

wherein a value range of the absolute value Q1 of the difference of intensity values of pixels of two adjacent rows in the same column is 0 to 255, and n is a positive integer larger than 1;

performing cumulative calculation according to the first intensity value weight k1 and the intensity values of pixels of two adjacent rows in each same column, and a formula is:

$$C1(Y)=\Sigma_{a=I(i,j)}^{I(i+1,j)}k1H1(a)$$

wherein i, j are positive integers, which respectively represents a row number and a column number where the pixel is, and I(i,j) is an intensity value of the pixel of ith row, jth column, and I(i+1,j) is an intensity value of the pixel of i+1th row, jth column, and H1(a) is an amount of the pixels, of which intensity values are a, and C1(Y) is a sum amount of the pixels corresponded with respective intensity values between I(i,j) and I(i+1,j);

step 52, calculating an absolute value Q2 of a difference of intensity values of pixels of two adjacent columns in each same row and a second intensity value weight k2;

a formula of the absolute value Q2 of the difference of intensity values of pixels of two adjacent columns in each same row is:

$$Q2=\mathrm{abs}(I(i,j)-I(i,j+1))$$

a formula of the second intensity value weight k2 is:

$$k2=\frac{\sqrt[n]{256}}{\sqrt[n]{Q2}}$$

wherein a value range of the absolute value Q2 of the difference of intensity values of pixels of two adjacent columns in the same row is 0 to 255, and n is a positive integer larger than 1 and is the same value in step 51;

performing cumulative calculation according to the second intensity value weight k2 and the intensity values of pixels of two adjacent columns in each same row, and a formula is:

$$C3(Y)=\Sigma_{a=I(i,j)}^{I(i,j+1)}k2H3(a)$$

wherein i, j are positive integers, which respectively represents a row number and a column number where the pixel is, and I(i,j) is an intensity value of the pixel of ith row, jth column, and I(i,j+1) is an intensity value of the pixel of ith row, j+1th column, and H3(a) is an amount of the pixels, of which intensity values are a, and C3(Y) is a sum amount of the pixels corresponded with respective intensity values between I(i,j) and I(i,j+1);

step 53, adding the C1(Y) in the step 51 and the C3(Y) in the step 52 to obtain C(Y);

$$C(Y)=C1(Y)+C3(Y)$$

step 54, maximum normalization, and a formula is:

$$N(Y)=(\Sigma_{a=0}^{255}C(a))/C(255)$$

and multiplying N(Y) by 255 to obtain an enhancement intensity table out(Y) with calculation, and looking up the table to obtain a new output intensity value I'=out(I (i,j)).

A specific procedure of the step 4 of calculating according to the histogram of the intensity component to obtain a conversion parameter is: first, obtaining an intensity value of which an amount is the most and an intensity value of the largest value;

and then, obtaining the conversion parameter according to the intensity value of which the amount is the most and the intensity value of the largest value, and a formula is: X=Max(hist(I))/Max(I), wherein X is the conversion parameter, and Max(hist(I)) is the intensity value of which an amount is the most, and Max(I) is the light intensity of the largest value.

The OLED display panel is an AMOLED display panel.

The pixel driving circuit in the OLED display panel comprises: a first thin film transistor, a second thin film transistor and a capacitor, and a gate of the first thin film transistor is inputted with a scan signal, and a source is inputted with a data signal composed by the new R' G' B' signal, and a drain is electrically coupled to a gate of the second thin film transistor and one end of the capacitor; a drain of the second thin film transistor is electrically coupled to a high driving voltage, and a source is electrically coupled to an anode of an organic light emitting diode; a cathode of the organic light emitting diode is inputted with the new low driving voltage; the one end of the capacitor is electrically coupled to the drain of the first thin film transistor, and the other end is electrically coupled to the drain of the second thin film transistor.

The present invention further provides a system of raising contrast of an OLED display panel, comprising:

a first conversion module: receiving an original RGB signal and an original low driving voltage of an image to be inputted to the OLED display panel, and converting the original RGB signal into a HSI color space constructed by a hue component, a saturation component and an intensity component;

a contrast enhancement module: electrically coupled to the first conversion module and employed to implement histogram statistics and contrast enhancement treatment to the intensity component to obtain a new intensity component and a conversion parameter, and calculating the conversion parameter and the original low driving voltage to obtain a new low driving voltage, and a formula is: OVSS'=K×X×OVSS, wherein OVSS' is the new low driving voltage, K is a constant coefficient, and X is the conversion parameter, and OVSS is the original low driving voltage;

a second conversion module: electrically coupled to the contrast enhancement module and the OLED display panel, and employed for converting the hue component, the saturation component and the new intensity component into a RGB color space to obtain a new R' G' B' signal, and inputting the new R' G' B' signal and the new low driving voltage to a pixel driving circuit in the OLED display panel, so that the OLED display panel shows a new image with an enhanced contrast.

A formula that the contrast enhancement module obtains the conversion parameter is: X=Max(hist(I))/Max(I), wherein X is the conversion parameter, and Max(hist(I)) is the intensity value of which the amount is the most, and Max(I) is the intensity of the largest value.

The OLED display panel is an AMOLED display panel.

The pixel driving circuit in the OLED display panel comprises: a first thin film transistor, a second thin film transistor and a capacitor, and a gate of the first thin film transistor is inputted with a scan signal, and a source is inputted with a data signal composed by the new R' G' B' signal, and a drain is electrically coupled to a gate of the second thin film transistor and one end of the capacitor; a drain of the second thin film transistor is electrically coupled to a high driving voltage, and a source is electrically coupled to an anode of an organic light emitting diode; a cathode of the organic light emitting diode is inputted with the new low driving voltage; the one end of the capacitor is electrically coupled to the drain of the first thin film transistor, and the other end is electrically coupled to the drain of the second thin film transistor.

The present invention further provides a system of raising contrast of an OLED display panel, comprising:

a first conversion module: receiving an original RGB signal and an original low driving voltage of an image to be inputted to the OLED display panel, and converting the original RGB signal into a HSI color space constructed by a hue component, a saturation component and an intensity component;

a contrast enhancement module: electrically coupled to the first conversion module and employed to implement histogram statistics and contrast enhancement treatment to the intensity component to obtain a new intensity component and a conversion parameter, and calculating the conversion parameter and the original low driving voltage to obtain a new low driving voltage, and a formula is: OVSS'=K×X×OVSS, wherein OVSS' is the new low driving voltage, K is a constant coefficient, and X is the conversion parameter, and OVSS is the original low driving voltage;

a second conversion module: electrically coupled to the contrast enhancement module and the OLED display panel, and employed for converting the hue component, the saturation component and the new intensity component into a RGB color space to obtain a new R' G' B' signal, and inputting the new R' G' B' signal and the new low driving voltage to a pixel driving circuit in the OLED display panel, so that the OLED display panel shows a new image with an enhanced contrast;

wherein a formula that the contrast enhancement module obtains the conversion parameter is: X=Max(hist(I))/Max(I), wherein X is the conversion parameter, and Max(hist(I)) is the intensity value of which the amount is the most, and Max(I) is the intensity of the largest value;

wherein the OLED display panel is an AMOLED display panel;

wherein the pixel driving circuit in the OLED display panel comprises: a first thin film transistor, a second thin film transistor and a capacitor, and a gate of the first thin film transistor is inputted with a scan signal, and a source is inputted with a data signal composed by the new R' G' B' signal, and a drain is electrically coupled to a gate of the second thin film transistor and one end of the capacitor; a drain of the second thin film transistor is electrically coupled to a high driving voltage, and a source is electrically coupled to an anode of an organic light emitting diode; a cathode of the organic light emitting diode is inputted with the new low driving voltage; the one end of the capacitor is electrically coupled to the drain of the first thin film transistor, and the other end is electrically coupled to the drain of the second thin film transistor.

The benefits of the present invention are: the method of raising contrast of OLED display panel provided by the present invention converts the original RGB signal into a HSI color space constructed by a hue component, a saturation component and an intensity component, and implements histogram statistics to the intensity component to obtain a histogram of the intensity component, and obtains a conversion parameter according to the histogram of the intensity component, and obtains the new low driving voltage with calculation of the conversion parameter in combination with the original low driving voltage, and meanwhile, keeps the hue component and the saturation component unchanged, and implements enhancement treatment to the intensity component to obtain a new intensity component, and then, converts the hue component, the saturation component and the new intensity component into a RGB color space to obtain a new R' G' B' signal, and provides the new R' G' B' signal and the new low driving voltage to a pixel driving circuit. The method can raise the contrast of the OLED display panel, promote the display quality of the OLED display panel and reduce the power consumption of the OLED display panel.

In order to better understand the characteristics and technical aspect of the invention, please refer to the following detailed description of the present invention is concerned with the diagrams, however, provide reference to the accompanying drawings and description only and is not intended to be limiting of the invention.

BRIEF DESCRIPTION OF THE DRAWINGS

The technical solution and the beneficial effects of the present invention are best understood from the following detailed description with reference to the accompanying figures and embodiments.

In drawings.

DETAILED DESCRIPTION OF PREFERRED EMBODIMENTS

For better explaining the technical solution and the effect of the present invention, the present invention will be further described in detail with the accompanying drawings and the specific embodiments.

Figure 1:
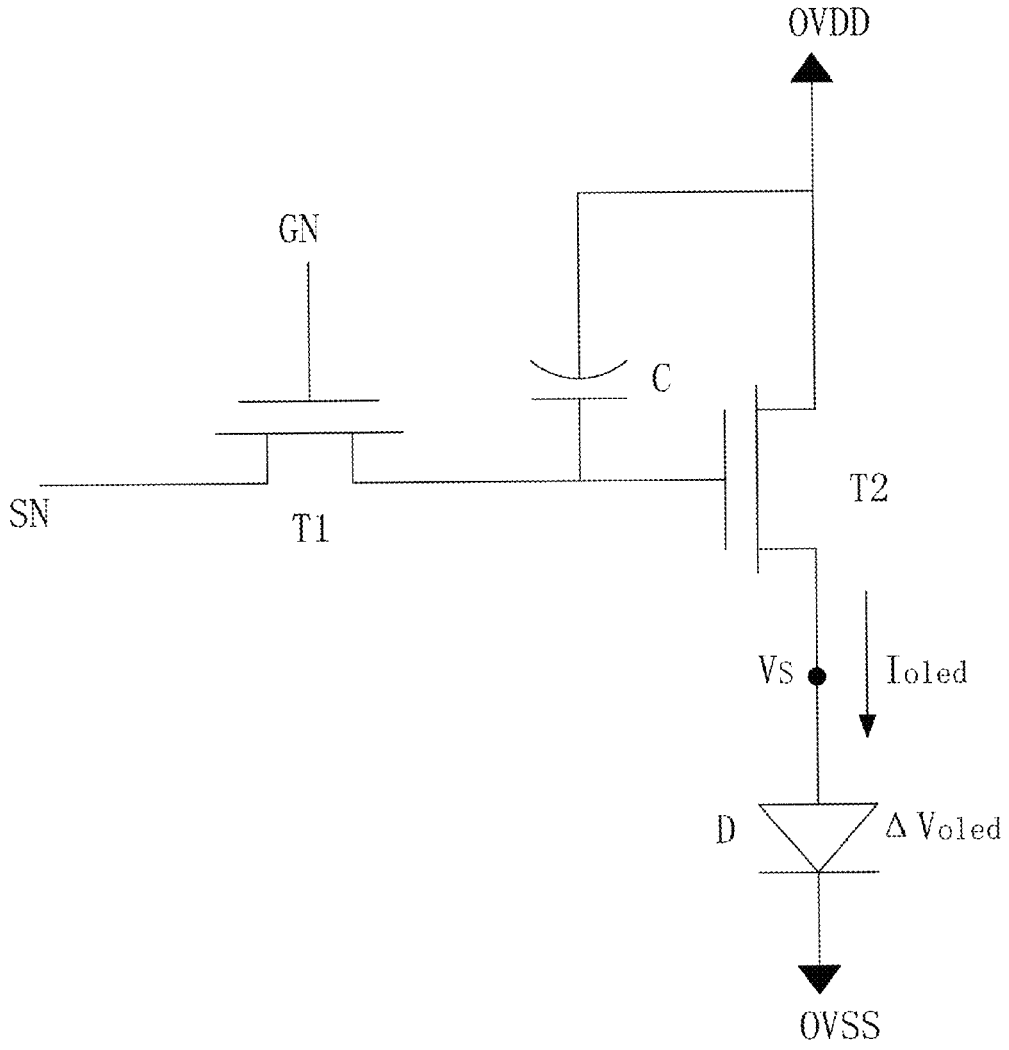
FIG. 1 is a circuit diagram of an AMOLED 2T1C pixel driving circuit according to prior art.
Figure 2:
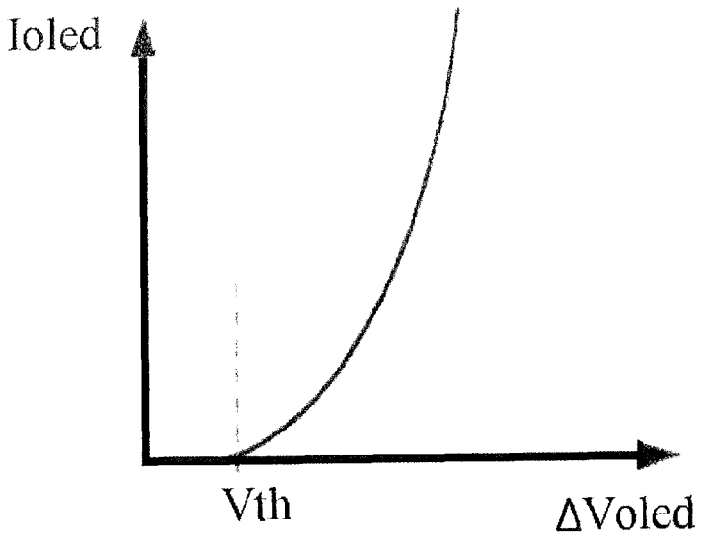
FIG. 2 is a relation curve diagram of the voltage and the driving current of two ends of the organic light emitting diode.
Figure 3:
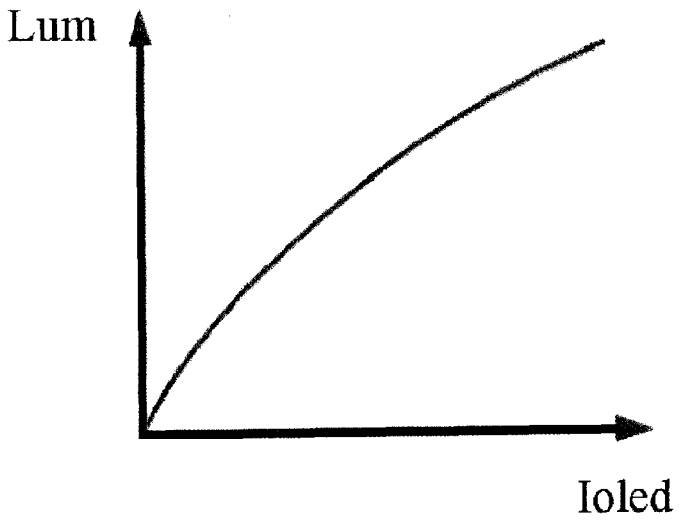
FIG. 3 is a relation curve diagram of the driving current and the intensity of the organic light emitting diode.
Figure 4:
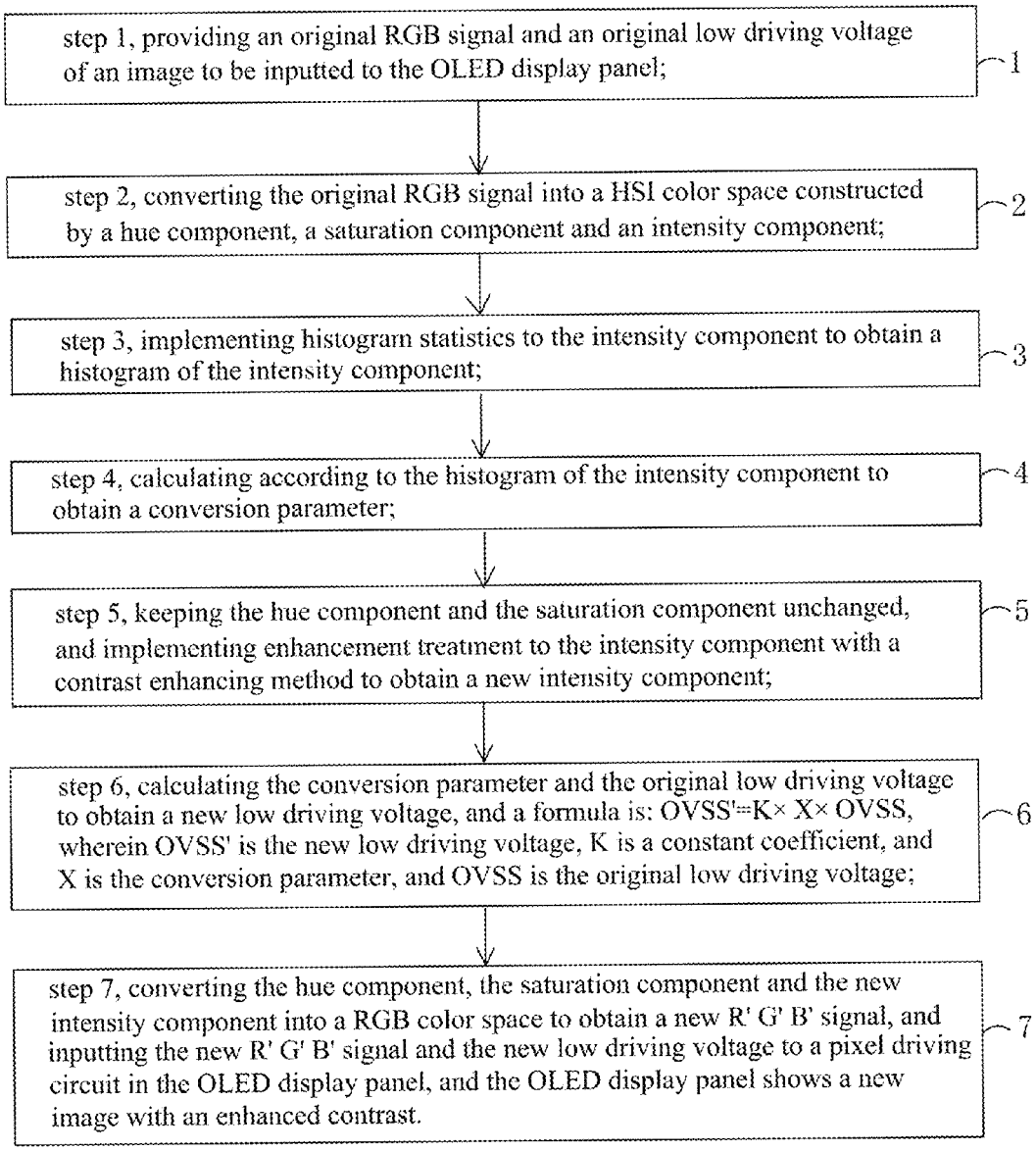
FIG. 4 is a flowchart of a method of raising contrast of OLED display panel according to the present invention.
Figure 5:
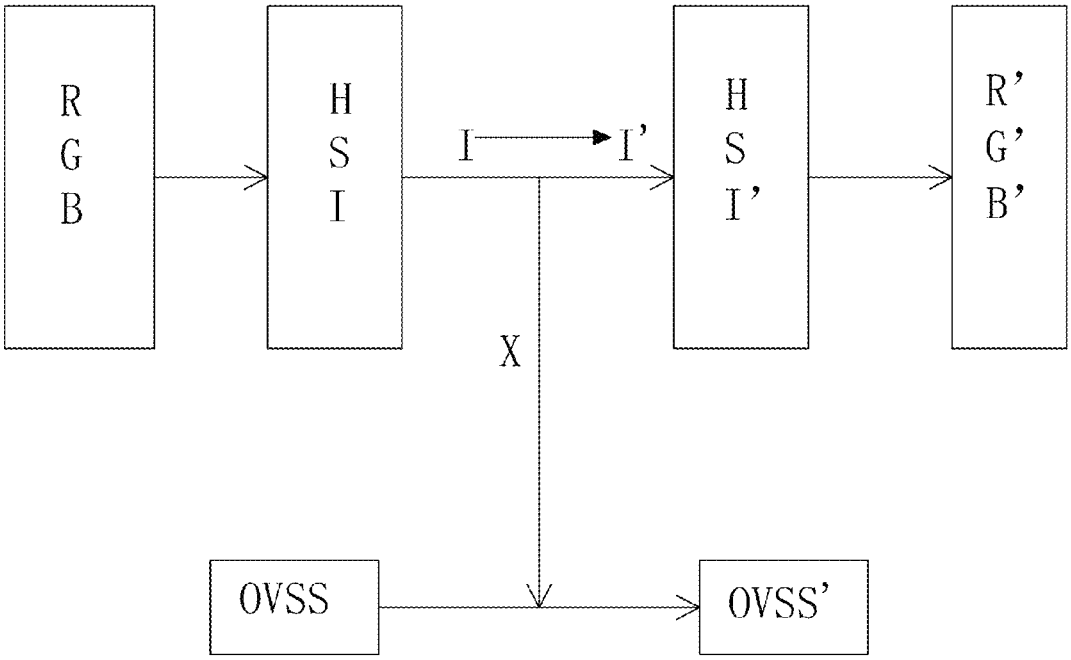
FIG. 5 is a conversion diagram of the signals in the method of raising contrast of OLED display panel according to the present invention.

Please refer to FIG. 4 and FIG. 5 at the same time. The present invention first provides a method of raising contrast of an OLED display panel, comprising steps of:

step 1, providing an original RGB signal and an original low driving voltage OVSS of an image to be inputted to the OLED display panel.

Figure 6:
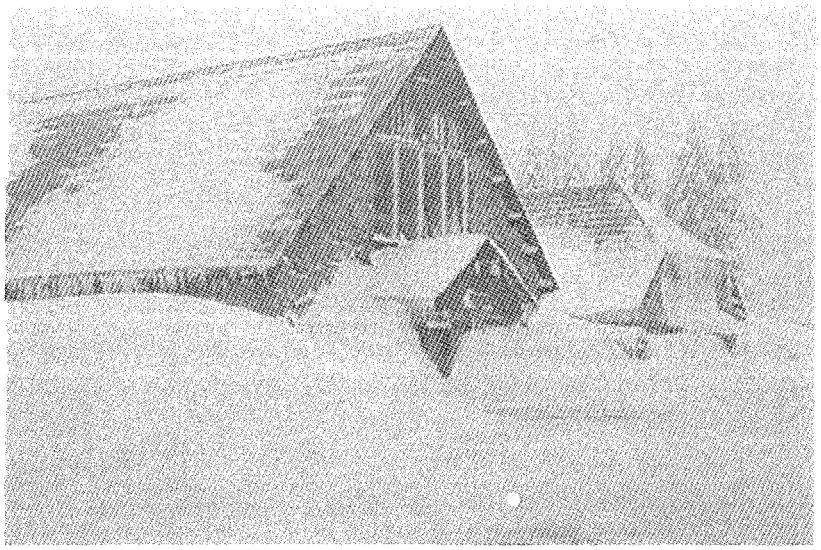
FIG. 6 is a diagram of an image to be inputted to the OLED display panel under an original RGB signal and an original low driving voltage.
Figure 7:
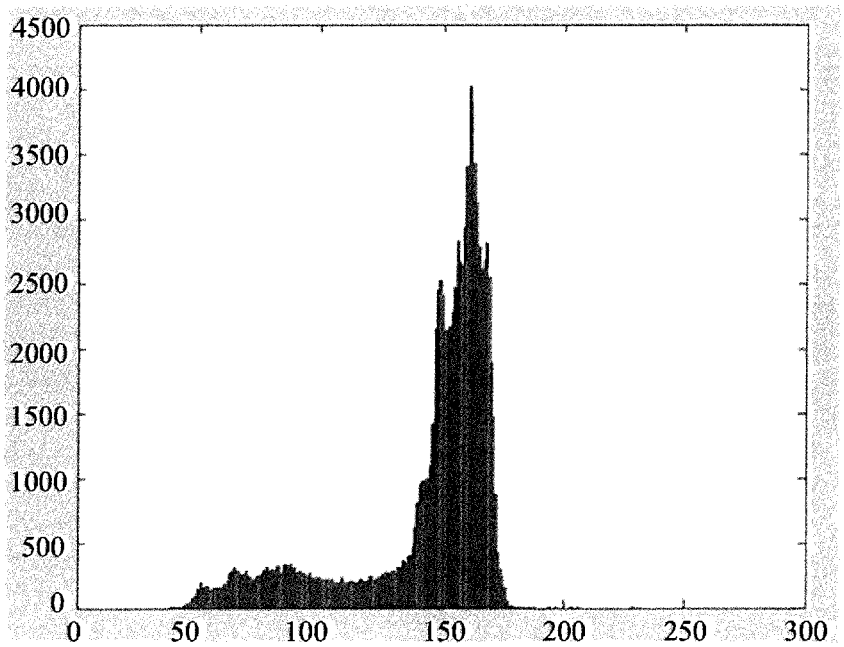
FIG. 7 is a histogram of the intensity component in the step 3 of the method of raising contrast of OLED display panel according to the present invention.

As shown in FIG. 6, the contrast of the image to be inputted to the OLED display panel under the original RGB signal and the original low driving voltage OVSS is lower and influences the display quality of the OLED display panel.

step 2, converting the original RGB signal into a HSI color space constructed by a hue component H, a saturation component S and an intensity component I.

step 3, as shown in FIG. 7, implementing histogram statistics to the intensity component to obtain a histogram of the intensity component I. The intensity component I is more concentrated in the histogram and the distribution is not uniform.

step 4, calculating according to the histogram of the intensity component shown in FIG. 7 to obtain a conversion parameter.

Specifically, a specific procedure of the step 4 of calculating according to the histogram of the intensity component to obtain a conversion parameter is:

first, obtaining an intensity value of which an amount is the most and an intensity value of the largest value;

and then, obtaining the conversion parameter according to the intensity value of which the amount is the most and the intensity value of the largest value, and a formula is: X=Max(hist(I))/Max(I), wherein X is the conversion parameter, and Max(hist(I)) is the intensity value of which an amount is the most, and Max(I) is the light intensity of the largest value.

step 5, keeping the hue component H and the saturation component S unchanged, and implementing enhancement treatment to the intensity component with a contrast enhancing method to obtain a new intensity component I'.

Specifically, a specific procedure of the step 5 of implementing enhancement treatment to the intensity component I with the contrast enhancing method to obtain the new intensity component I' is:

step 51, calculating an absolute value Q1 of a difference of intensity values of pixels of two adjacent rows in each same column and a first intensity value weight k1;

a formula of the absolute value Q1 of the difference of intensity values of pixels of two adjacent rows in each same column is:

$$Q1=\mathrm{abs}(I(i,j)-I(i+1,j))$$

a formula of the first intensity value weight k1 is:

$$k1=\frac{\sqrt[n]{256}}{\sqrt[n]{Q1}}$$

wherein a value range of the absolute value Q1 of the difference of intensity values of pixels of two adjacent rows in the same column is 0 to 255, and n is a positive integer larger than 1;

performing cumulative calculation according to the first intensity value weight k1 and the intensity values of pixels of two adjacent rows in each same column, and a formula is:

$$C1(Y)=\Sigma_{a=I(i,j)}^{I(i+1,j)}k1H1(a)$$

wherein i, j are positive integers, which respectively represents a row number and a column number where the pixel is, and I(i,j) is an intensity value of the pixel of ith row, jth column, and I(i+1,j) is an intensity value of the pixel of i+1th row, jth column, and H1(a) is an amount of the pixels, of which intensity values are a, and C1(Y) is a sum amount of the pixels corresponded with respective intensity values between I(i,j) and I(i+1,j);

step 52, calculating an absolute value Q2 of a difference of intensity values of pixels of two adjacent columns in each same row and a second intensity value weight k2;

a formula of the absolute value Q2 of the difference of intensity values of pixels of two adjacent columns in each same row is:

$$Q2=\mathrm{abs}(I(i,j)-I(i,j+1))$$

a formula of the second intensity value weight k2 is:

$$k2=\frac{\sqrt[n]{256}}{\sqrt[n]{Q2}}$$

wherein a value range of the absolute value Q2 of the difference of intensity values of pixels of two adjacent columns in the same row is 0 to 255, and n is a positive integer larger than 1 and is the same value in step 51;

performing cumulative calculation according to the second intensity value weight k2 and the intensity values of pixels of two adjacent columns in each same row, and a formula is:

$$C3(Y)=\Sigma_{a=I(i,j)}^{I(i,j+1)}k2H3(a)$$

wherein i, j are positive integers, which respectively represents a row number and a column number where the pixel is, and I(i,j) is an intensity value of the pixel of ith row, jth column, and I(i,j+1) is an intensity value of the pixel of ith row, j+1th column, and H3(a) is an amount of the pixels, of which intensity values are a, and C3(Y) is a sum amount of the pixels corresponded with respective intensity values between I(i,j) and I(i,j+1);

step 53, adding the C1(Y) in the step 51 and the C3(Y) in the step 52 to obtain C(Y);

$$C(Y)=C1(Y)+C3(Y)$$

step 54, maximum normalization, and a formula is:

$$N(Y)=(\Sigma_{a=0}^{255}C(a))/C(255)$$

and multiplying N(Y) by 255 to obtain an enhancement intensity table out(Y) with calculation, and looking up the table to obtain a new output intensity value I'=out(I (i,j)).

Figure 8:
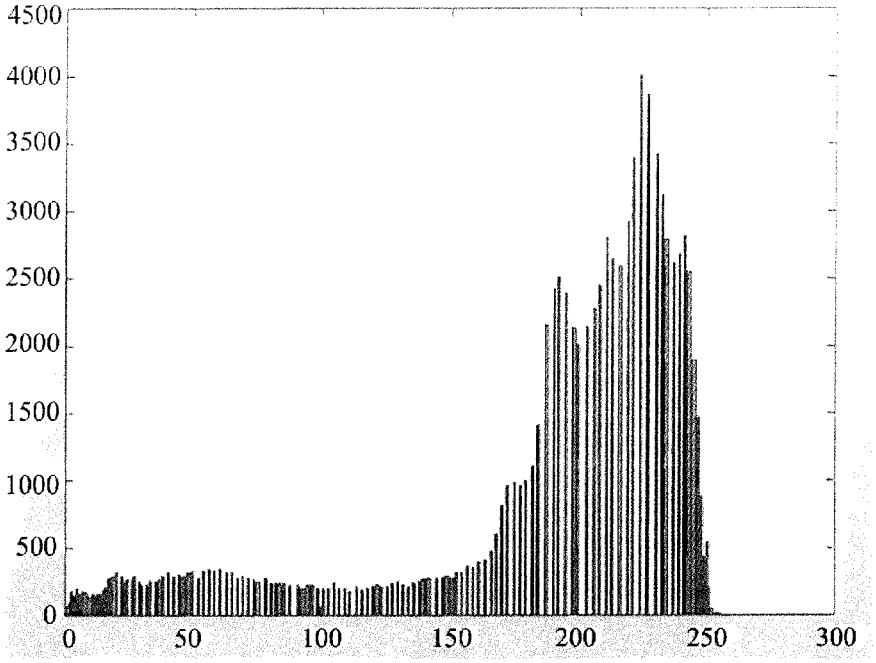
FIG. 8 is a histogram of the new intensity component obtained after the contrast enhancement treatment in the step 5 of the method of raising contrast of OLED display panel according to the present invention.
Figure 9:
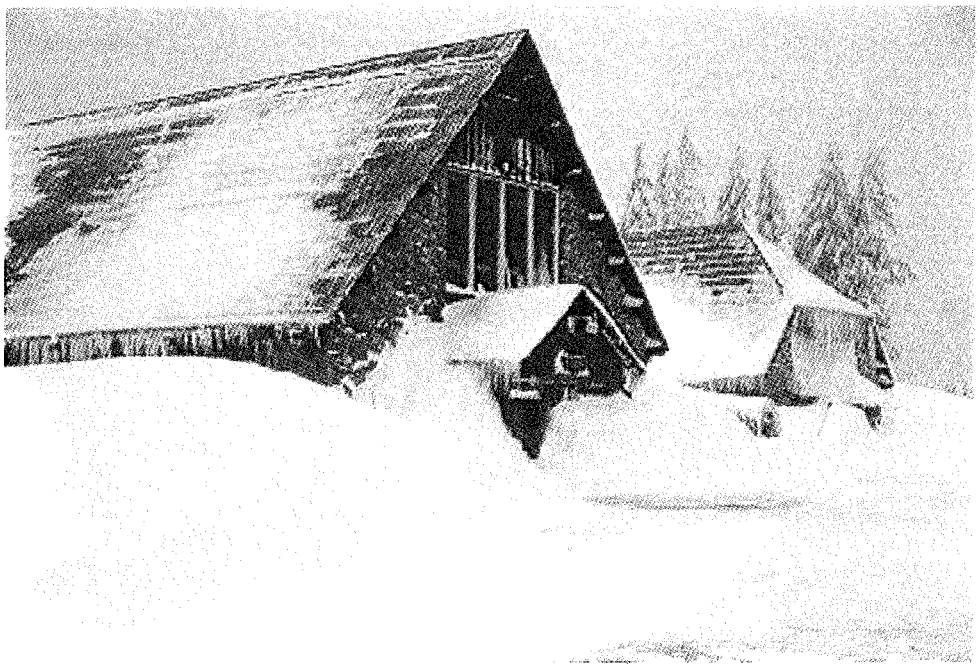
FIG. 9 is a diagram of an image inputted to the OLED display panel after process with the method of raising contrast of OLED display panel according to the present invention.

The histogram of the new intensity component I' after the contrast enhancement treatment implemented in the step 5 is shown in FIG. 8. The new intensity component I' after the treatment is more uniformly distributed in the histogram.

step 6, calculating the conversion parameter X and the original low driving voltage OVSS to obtain a new low driving voltage OVSS', and a formula is: OVSS'=K×X×OVSS, wherein OVSS' is the new low driving voltage, K is a constant coefficient, and X is the conversion parameter, and OVSS is the original low driving voltage.

step 7, converting the hue component H, the saturation component S and the new intensity component I' into a RGB color space to obtain a new R' G' B' signal, and inputting the new R' G' B' signal and the new low driving voltage OVSS' to a pixel driving circuit in the OLED display panel, and the OLED display panel shows a new image with an enhanced contrast as shown in FIG. 9 to promote the display quality of the OLED display panel.

Figure 11:
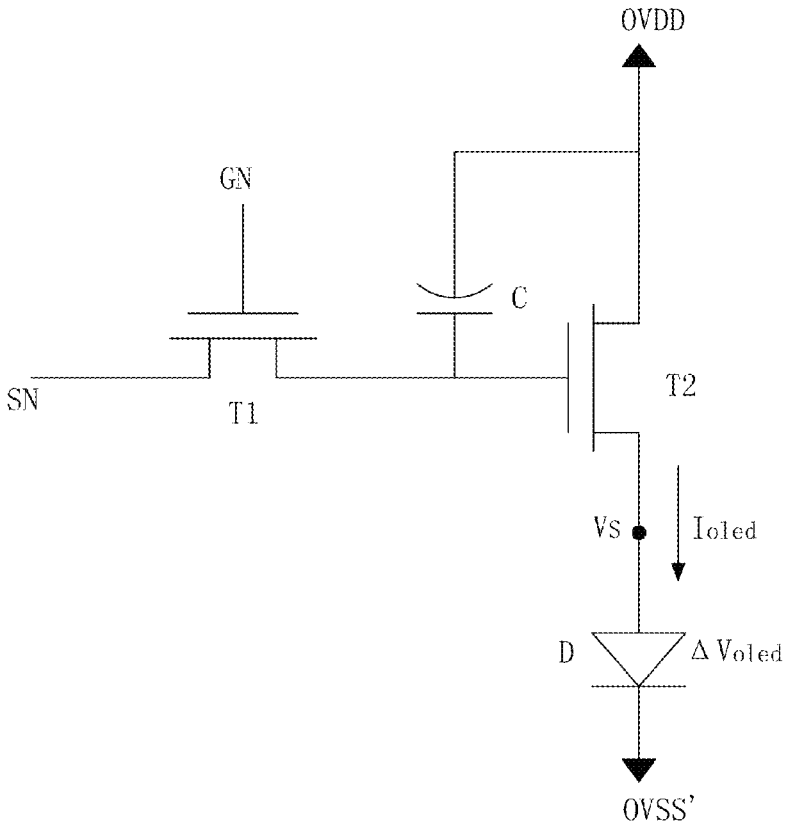
FIG. 11 is a circuit diagram of a 2T1C pixel driving circuit in the system of raising contrast of OLED display panel according to the present invention.

Furthermore, the OLED display panel can selectively be an AMOLED display panel. As shown in FIG. 11, the pixel driving circuit in the OLED display panel can selectively be a 2T1C pixel driving circuit, comprising: a first thin film transistor T1, a second thin film transistor T2 and a capacitor C, and a gate of the first thin film transistor T1 is inputted with a scan signal GN, and a source is inputted with a data signal SN composed by the new R' G' B' signal, and a drain is electrically coupled to a gate of the second thin film transistor T2 and one end of the capacitor C; a drain of the second thin film transistor T2 is electrically coupled to a high driving voltage OVDD, and a source is electrically coupled to an anode of an organic light emitting diode D; a cathode of the organic light emitting diode D is inputted with the new low driving voltage OVSS'; the one end of the capacitor C is electrically coupled to the drain of the first thin film transistor T1, and the other end is electrically coupled to the drain of the second thin film transistor T2.

Significantly, by applying the new low driving voltage OVSS' to the cathode of the organic light emitting diode D, the voltage difference ΔVoled between the anode and the cathode of the organic light emitting diode D can be decreased to reduce the power consumption of the OLED display panel.

Figure 10:
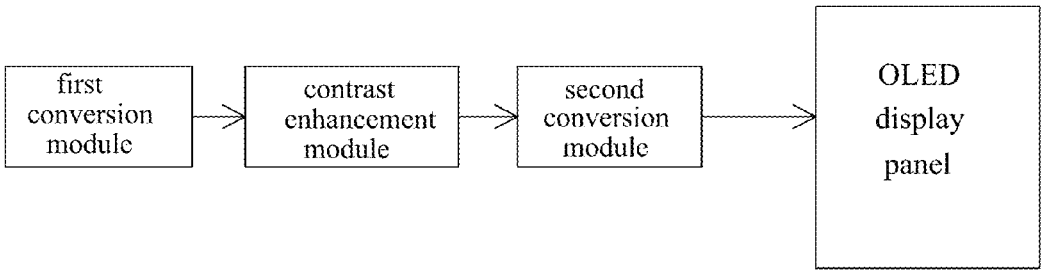
FIG. 10 is a structure block diagram of a system of raising contrast of OLED display panel according to the present invention.

Please refer to FIG. 10 and FIG. 11 at the same time in combination with FIG. 5. On the basis of the same inventive idea, the present invention further provides a system of raising contrast of an OLED display panel, comprising:

a first conversion module: receiving an original RGB signal and an original low driving voltage OVSS of an image to be inputted to the OLED display panel, and converting the original RGB signal into a HSI color space constructed by a hue component H, a saturation component S and an intensity component I.

A contrast enhancement module: electrically coupled to the first conversion module and employed to implement histogram statistics and contrast enhancement treatment to the intensity component to obtain a new intensity component I' and a conversion parameter X, and calculating the conversion parameter X and the original low driving voltage OVSS to obtain a new low driving voltage OVSS', and a formula is: OVSS'=K×X×OVSS, wherein OVSS' is the new low driving voltage, K is a constant coefficient, and X is the conversion parameter, and OVSS is the original low driving voltage.

Specifically, the contrast enhancement module implements histogram statistics to the intensity component I to obtain a histogram of the intensity component I and then, obtains the conversion parameter X according to the intensity value of which the amount is the most and the intensity value of the largest value, and a formula is: X=Max(hist(I))/Max(I), wherein X is the conversion parameter, and Max (hist(I)) is the intensity value of which an amount is the most, and Max(I) is the light intensity of the largest value.

a second conversion module: electrically coupled to the contrast enhancement module and the OLED display panel, and employed for converting the hue component H, the saturation component S and the new intensity component I into a RGB color space to obtain a new R' G' B' signal, and inputting the new R' G' B' signal and the new low driving voltage OVSS' to a pixel driving circuit in the OLED display panel, so that the OLED display panel shows a new image with an enhanced contrast.

Furthermore, the OLED display panel can selectively be an AMOLED display panel. As shown in FIG. 11, the pixel driving circuit in the OLED display panel can selectively be a 2T1C pixel driving circuit, comprising: a first thin film transistor T1, a second thin film transistor T2 and a capacitor C, and a gate of the first thin film transistor T1 is inputted with a scan signal GN, and a source is inputted with a data signal SN composed by the new R' G' B' signal, and a drain is electrically coupled to a gate of the second thin film transistor T2 and one end of the capacitor C; a drain of the second thin film transistor T2 is electrically coupled to a high driving voltage OVDD, and a source is electrically coupled to an anode of an organic light emitting diode D; a cathode of the organic light emitting diode D is inputted with the new low driving voltage OVSS'; the one end of the capacitor C is electrically coupled to the drain of the first thin film transistor T1, and the other end is electrically coupled to the drain of the second thin film transistor T2.

In the system of raising contrast of OLED display panel according to the present invention, the first conversion module converts the original RGB signal into a HSI color space constructed by a hue component H, a saturation component S and an intensity component I, and the contrast enhancement module implements histogram statistics and contrast enhancement treatment to the intensity component I to obtain a new intensity component I' and a conversion parameter X, and calculates the conversion parameter X and the original low driving voltage OVSS to obtain a new low driving voltage OVSS', and then the second conversion module converts the hue component H, the saturation component S and the new intensity component I into a RGB color space to obtain a new R' G' B' signal, and inputs the new R' G' B' signal and the new low driving voltage OVSS' to the pixel driving circuit in the OLED display panel, so that the OLED display panel shows a new image with an enhanced contrast. Besides, because it is the new low driving voltage OVSS' applied to the cathode of the organic light emitting diode D, the voltage difference ΔVoled between the anode and the cathode of the organic light emitting diode D can be decreased to reduce the power consumption of the OLED display panel.

In conclusion, the method of raising contrast of OLED display panel according to the present invention converts the original RGB signal into a HSI color space constructed by a hue component, a saturation component and an intensity component, and implements histogram statistics to the intensity component to obtain a histogram of the intensity component, and obtains a conversion parameter according to the histogram of the intensity component, and obtains the new low driving voltage with calculation of the conversion parameter in combination with the original low driving voltage, and meanwhile, keeps the hue component and the saturation component unchanged, and implements enhancement treatment to the intensity component to obtain a new intensity component, and then, converts the hue component, the saturation component and the new intensity component into a RGB color space to obtain a new R' G' B' signal, and provides the new R' G' B' signal and the new low driving voltage to a pixel driving circuit. The method can raise the contrast of the OLED display panel, promote the display quality of the OLED display panel and reduce the power consumption of the OLED display panel.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A method of raising contrast of an OLED display panel, comprising steps of:

step 1, providing an original RGB signal and an original low driving voltage of an image to be inputted to the OLED display panel;

step 2, converting the original RGB signal into a HSI color space constructed by a hue component, a saturation component and an intensity component;

step 3, implementing histogram statistics to the intensity component to obtain a histogram of the intensity component;

step 4, calculating according to the histogram of the intensity component to obtain a conversion parameter;

step 5, keeping the hue component and the saturation component unchanged, and implementing enhancement treatment to the intensity component with a contrast enhancing method to obtain a new intensity component;

step 6, calculating the conversion parameter and the original low driving voltage to obtain a new low driving voltage, and a formula is: OVSS'=K×X×OVSS, wherein OVSS' is the new low driving voltage, K is a constant coefficient, and X is the conversion parameter, and OVSS is the original low driving voltage;

step 7, converting the hue component, the saturation component and the new intensity component into a RGB color space to obtain a new R'G'B' signal, and inputting the new R'G'B' signal and the new low driving voltage to a pixel driving circuit in the OLED display panel, and the OLED display panel shows a new image with an enhanced contrast.

2. The method of raising contrast of an OLED display panel according to claim 1, wherein a specific procedure of step 5 of implementing enhancement treatment to the intensity component with the contrast enhancing method to obtain the new intensity component is:

step 5.1, calculating an absolute value Q1 of a difference of intensity values of pixels of two adjacent rows in each same column and a first intensity value weight k1;

a formula of the absolute value Q1 of the difference of intensity values of pixels of two adjacent rows in each same column is:

$$Q1=\mathrm{abs}(I(i,j)-I(i+1,j))$$

a formula of the first intensity value weight k1 is:

$$k1=\frac{\sqrt[n]{256}}{\sqrt[n]{Q1}}$$

wherein a value range of the absolute value Q1 of the difference of intensity values of pixels of two adjacent rows in the same column is 0 to 255, and n is a positive integer larger than 1;

performing cumulative calculation according to the first intensity value weight k1 and the intensity values of pixels of two adjacent rows in each same column, and a formula is:

$$C1(Y)=\Sigma_{a=I(i,j)}^{I(i+1,j)}k1H1(a)$$

wherein i, j are positive integers, which respectively represents a row number and a column number where the pixel is, and I(i,j) is an intensity value of the pixel of ith row, jth column, and I(i+1,j) is an intensity value of the pixel of i+1th row, jth column, and H1(a) is an amount of the pixels, of which intensity values are a, and C1(Y) is a sum amount of the pixels corresponded with respective intensity values between I(i,j) and I(i+1,j);

step 5.2, calculating an absolute value Q2 of a difference of intensity values of pixels of two adjacent columns in each same row and a second intensity value weight k2;

a formula of the absolute value Q2 of the difference of intensity values of pixels of two adjacent columns in each same row is:

$$Q2=\mathrm{abs}(I(i,j)-I(i,j+1))$$

a formula of the second intensity value weight k2 is:

$$k2=\frac{\sqrt[n]{256}}{\sqrt[n]{Q2}}$$

wherein a value range of the absolute value Q2 of the difference of intensity values of pixels of two adjacent columns in the same row is 0 to 255, and n is a positive integer larger than 1 and is the same value in step 5.1;

performing cumulative calculation according to the second intensity value weight k2 and the intensity values of pixels of two adjacent columns in each same row, and a formula is:

$$C3(Y)=\Sigma_{a=I(i,j)}^{I(i,j+1)}k2H3(a)$$

wherein i, j are positive integers, which respectively represents a row number and a column number where the pixel is, and I(i,j) is an intensity value of the pixel of ith row, jth column, and I(i,j+1) is an intensity value of the pixel of ith row, j+1th column, and H3(a) is an amount of the pixels, of which intensity values are a, and C3(Y) is a sum amount of the pixels corresponded with respective intensity values between I(i,j) and I(i,j+1);

step 5.3, adding the C1(Y) in step 5.1 and the C3(Y) in step 5.2 to obtain C(Y);

$$C(Y)=C1(Y)+C3(Y)$$

step 5.4 maximum normalization, and a formula is:

$$N(Y)=(\Sigma_{a=0}^{255}C(a))/C(255)$$

and multiplying N(Y) by 255 to obtain an enhancement intensity table out(Y) with calculation, and looking up the table to obtain a new output intensity value I'=out(I(i,j)).

3. The method of raising contrast of an OLED display panel according to claim 1, wherein a specific procedure of the step 4 of calculating according to the histogram of the intensity component to obtain a conversion parameter is:

first, obtaining an intensity value of which an amount is the most and an intensity value of the largest value;

and then, obtaining the conversion parameter according to the intensity value of which the amount is the most and the intensity value of the largest value, and a formula is: X=Max(hist(I))/Max(I), wherein X is the conversion parameter, and Max(hist(I)) is the intensity value of which an amount is the most, and Max(I) is the light intensity of the largest value.

4. The method of raising contrast of an OLED display panel according to claim 1, wherein the OLED display panel is an AMOLED display panel.

5. The method of raising contrast of an OLED display panel according to claim 4, wherein the pixel driving circuit in the OLED display panel comprises: a first thin film transistor, a second thin film transistor and a capacitor, and a gate of the first thin film transistor is inputted with a scan signal, and a source is inputted with a data signal composed by the new R'G'B' signal, and a drain is electrically coupled to a gate of the second thin film transistor and one end of the capacitor; a drain of the second thin film transistor is electrically coupled to a high driving voltage, and a source is electrically coupled to an anode of an organic light emitting diode; a cathode of the organic light emitting diode is inputted with the new low driving voltage; the one end of the capacitor is electrically coupled to the drain of the first thin film transistor, and the other end is electrically coupled to the drain of the second thin film transistor.

6. A system of raising contrast of an OLED display panel, comprising:

a first conversion module: receiving an original RGB signal and an original low driving voltage of an image to be inputted to the OLED display panel, and converting the original RGB signal into a HSI color space constructed by a hue component, a saturation component and an intensity component;

a contrast enhancement module: electrically coupled to the first conversion module and employed to implement histogram statistics and contrast enhancement treatment to the intensity component to obtain a new intensity component and a conversion parameter, and calculating the conversion parameter and the original low driving voltage to obtain a new low driving voltage, and a formula is: OVSS'=K×X×OVSS, wherein OVSS' is the new low driving voltage, K is a constant coefficient, and X is the conversion parameter, and OVSS is the original low driving voltage;

a second conversion module: electrically coupled to the contrast enhancement module and the OLED display panel, and employed for converting the hue component, the saturation component and the new intensity component into a RGB color space to obtain a new R'G'B' signal, and inputting the new R'G'B' signal and the new low driving voltage to a pixel driving circuit in the OLED display panel, so that the OLED display panel shows a new image with an enhanced contrast.

7. The system of raising contrast of an OLED display panel according to claim 6, wherein a formula that the contrast enhancement module obtains the conversion parameter is: X=Max(hist(I))/Max(I), wherein X is the conversion parameter, and Max(hist(I)) is the intensity value of which the amount is the most, and Max(I) is the intensity of the largest value.

8. The system of raising contrast of an OLED display panel according to claim 6, wherein the OLED display panel is an AMOLED display panel.

9. The system of raising contrast of an OLED display panel according to claim 8, wherein the pixel driving circuit in the OLED display panel comprises: a first thin film transistor, a second thin film transistor and a capacitor, and a gate of the first thin film transistor is inputted with a scan signal, and a source is inputted with a data signal composed by the new R'G'B' signal, and a drain is electrically coupled to a gate of the second thin film transistor and one end of the capacitor; a drain of the second thin film transistor is electrically coupled to a high driving voltage, and a source is electrically coupled to an anode of an organic light emitting diode; a cathode of the organic light emitting diode is inputted with the new low driving voltage; the one end of the capacitor is electrically coupled to the drain of the first thin film transistor, and the other end is electrically coupled to the drain of the second thin film transistor.

10. A system of raising contrast of an OLED display panel, comprising:

a first conversion module: receiving an original RGB signal and an original low driving voltage of an image to be inputted to the OLED display panel, and converting the original RGB signal into a HSI color space constructed by a hue component, a saturation component and an intensity component;

a contrast enhancement module: electrically coupled to the first conversion module and employed to implement histogram statistics and contrast enhancement treatment to the intensity component to obtain a new intensity component and a conversion parameter, and calculating the conversion parameter and the original low driving voltage to obtain a new low driving voltage, and a formula is: OVSS'=K×X×OVSS, wherein OVSS' is the new low driving voltage, K is a constant coefficient, and X is the conversion parameter, and OVSS is the original low driving voltage;

a second conversion module: electrically coupled to the contrast enhancement module and the OLED display panel, and employed for converting the hue component, the saturation component and the new intensity component into a RGB color space to obtain a new R' G' B' signal, and inputting the new R' G' B' signal and the new low driving voltage to a pixel driving circuit in the OLED display panel, so that the OLED display panel shows a new image with an enhanced contrast;

wherein a formula that the contrast enhancement module obtains the conversion parameter is: X=Max(hist(I))/Max(I), wherein X is the conversion parameter, and Max(hist(I)) is the intensity value of which the amount is the most, and Max(I) is the intensity of the largest value;

wherein the OLED display panel is an AMOLED display panel;

wherein the pixel driving circuit in the OLED display panel comprises: a first thin film transistor, a second thin film transistor and a capacitor, and a gate of the first thin film transistor is inputted with a scan signal, and a source is inputted with a data signal composed by the new R'G'B' signal, and a drain is electrically coupled to a gate of the second thin film transistor and one end of the capacitor; a drain of the second thin film transistor is electrically coupled to a high driving voltage, and a source is electrically coupled to an anode of an organic light emitting diode; a cathode of the organic light emitting diode is inputted with the new low driving voltage; the one end of the capacitor is electrically coupled to the drain of the first thin film transistor, and the other end is electrically coupled to the drain of the second thin film transistor.

* * * * *